US005236800A

United States Patent [19]

Nakamura et al.

[11] Patent Number: 5,236,800

[45] Date of Patent: Aug. 17, 1993

[54] HEAT-DEVELOPABLE LIGHT-SENSITIVE COPYING MATERIAL COMPRISING MICROCAPSULES HAVING SUBSTANTIALLY NO SOLVENT

[75] Inventors: Kotaro Nakamura; Hirokazu Shimada, both of Shizuoka, Japan

[73] Assignee: Fuji Photo Film Co., Ltd., Kanagawa, Japan

[21] Appl. No.: 337,196

[22] Filed: Apr. 12, 1989

[30] Foreign Application Priority Data

| | | | |
|---|---|---|---|
| Apr. 12, 1988 | [JP] | Japan | 63-89878 |
| May 2, 1988 | [JP] | Japan | 63-109551 |
| May 17, 1988 | [JP] | Japan | 63-120203 |
| May 20, 1988 | [JP] | Japan | 63-123049 |

[51] Int. Cl.[5] ..... G03C 1/72; G03C 1/58; B41M 5/20

[52] U.S. Cl. ..... 430/138; 430/138; 430/157; 430/171; 430/180; 430/181; 430/151; 503/214; 503/215

[58] Field of Search ..... 430/151, 138, 181, 176, 430/180, 182, 157; 503/213, 215, 214

[56] References Cited

U.S. PATENT DOCUMENTS

| | | | |
|---|---|---|---|
| 3,111,407 | 2/1960 | Lindquist et al. | 430/138 |
| 3,281,244 | 10/1966 | Endermann et al. | 430/138 |
| 3,322,556 | 5/1967 | Munder et al. | 430/138 |
| 3,360,371 | 12/1967 | Munder | 430/138 |
| 3,429,827 | 2/1969 | Ruus et al. | 430/138 |
| 4,636,462 | 1/1987 | Kawata et al. | 430/151 |
| 4,695,525 | 9/1987 | Tsukase et al. | 430/151 |
| 4,771,032 | 9/1988 | Yamaguchi et al. | 430/151 |
| 4,828,957 | 5/1989 | Yonese et al. | 430/151 |
| 4,895,826 | 1/1990 | Watanabe et al. | 430/151 |

FOREIGN PATENT DOCUMENTS

| | | |
|---|---|---|
| 0346484 | 1/1981 | European Pat. Off. . |
| 0123224 | 4/1991 | European Pat. Off. . |
| 2206218 | 12/1992 | United Kingdom . |

OTHER PUBLICATIONS

Patent Abstracts of Japan, vol. 6, No. 263 (M-181) [1141], Dec. 22, 1982, JP-A-57 157 788, (RICOH K.K.) Sep. 29, 1982 (Abstract).

Research Disclosure, No. 145, May 1976, Abstract No. 14544, Havant, GB; D. C. Mitchell et al.: "Concentration of Microcapsule-containing Suspensions", Whole Document.

*Primary Examiner*—Charles L. Bowers, Jr.
*Assistant Examiner*—John S. Chu
*Attorney, Agent, or Firm*—Sughrue, Mion, Zinn, Macpeak & Seas

[57] ABSTRACT

A heat-developable copying material comprising a support having thereon a heat-developable light-sensitive layer comprising microcapsules containing a diazo compound and substantially no solvent, a coupling component and a color basic substance.

13 Claims, No Drawings

HEAT-DEVELOPABLE LIGHT-SENSITIVE COPYING MATERIAL COMPRISING MICROCAPSULES HAVING SUBSTANTIALLY NO SOLVENT

FIELD OF THE INVENTION

This invention relates to a copying material containing a diazo compound (diazonium salt) enclosed in microcapsules, and more particularly to a copying material having a good shelf life.

BACKGROUND OF THE INVENTION

Three types of copying materials are known which utilize the light-sensitivity of diazo compounds. One is a wet-process development type copying material in which a light-sensitive layer comprising mainly a diazo compound and a coupling component is provided on a support and in which development is carried out by using an alkaline solution after imagewise exposing the material superposed with an original. The second type is known as a dry-process development type copying material in which development is carried out by using ammonia gas, unlike the wet-process copying material. The third type is known as a heat-developable copying material. Examples of the heat-developable copying material include a type in which its light-sensitive layer contains an ammonia gas-generating agent (e.g., urea) capable of generating ammonia gas upon heating, a type in which its light-sensitive layer contains an alkali metal salt of an acid (e.g., trichloroacetic acid) having such a property that the acid loses its acidic property upon heating, and a type in which a higher fatty acid amide used as a color forming aid is melted by heating to activate a diazo compound and a coupling component.

The wet-process copying material has some problems because developing solutions are used. For example, much labor for supplementing or disposing of the solution is required. Apparatuses are large so that there is a problem in the maintenance thereof. Copies immediately after copying are wet and hence retouching can not be immediately done. Also, the copied image can not be preserved over a long period of time.

The dry process copying material requires supplementing the developer as in the wet-process copying material by providing a gas absorption equipment so that evolved ammonia gas does not escape. Therefore, there are the problems that apparatuses are large-sized and there is odor of ammonia ga immediately after copying.

The heat developable copying material has the merit that no developing solution is used, unlike the wet-process copying material and the dry-process copying material. However, conventional heat-developable copying material has problems, such as the need of a high developing temperature as high as 150° to 200° C. Further, underdevelopment or change of color tone occurs unless the temperature is controlled within ±10° C., and hence the equipment cost is increased. Diazo compounds for use in such high-temperature development must have high heat resistance, but such compounds have often a disadvantage in the use thereof at a high density. Attempts have been made to conduct low-temperature development (90° to 130° C.). However, the low-temperature development has the defect that the shelf life of the copying material itself is lowered.

As described above, although the heat-developable copying material has merits as compared with the wet-process type and the dry-process copying materials, the heat-developable copying material has not been accepted as the main stream of diazo type copying systems as yet.

In order to obtain a desired color density by heating a heat-developable copying material comprising a layer containing a diazo compound, a coupling component and a basic substance, it is necessary that these components are instantaneously melted, diffused and reacted to form a colored dye. When the system is basic during the reaction, an effect of accelerating the reaction can be obtained. Accordingly, a basic substance must be incorporated in the layer to prepare a heat-developable copying material exhibiting a copying rate suitable with low-temperature heat development.

On the other hand, a possibility that the background of the heat-developable copying material is colored during storage before copying should be inhibited, or color density is lowered.

Attempts have been made to prepare a heat-developable copying material having good shelf life as well as high copying speed. However, a material has not been achieved which can be put to practical use.

When a material is so designed that color formation is sufficient even at a low heating temperature to give a high density, there is a possibility that a coloring reaction takes place even during the course of storage at room temperature before copying and as a result, the background which must be white is colored.

The present inventors have made studies to solve the above problems, which are apparently not eliminated in a simultaneous manner. They have found that one fundamental solution is to enclose a diazo compound in microcapsules in the copying material comprising a heat-developable light-sensitive layer containing the diazo compound, a coupling component and a basic substance provided on a support. However, though the background of the material can be somewhat prevented from being colored during the course of storage before copying, but insufficiently, the problem of lowering in color density is left still unsolved. Further, with a copying material containing a diazonium salt enclosed in microcapsules, its light-sensitive layer is opaque and copy can not be used as the original drawing in the reproduction of drawings for which the copying material is frequently used.

There are known many methods for producing microcapsules containing hydrophobic liquids. Examples of the methods include the following methods.

(1) Phase separation methods from aqueous solution (U.S. Pat. Nos. 2,900,457 and 2,800,458), which are the most popular methods and put into practical use and utilize the coacervation of hydrophilic colloidal sol.

(2) Interfacial polymerization methods (JP-B-38-19574 (the term "JP B" as used herein means an "examined Japanese patent publication"), JP-B-42-446, JP-B-42-771, British Patents 989,264, 950,443, 867,797, 1,069,140 and 1,046,409) in which a monomer component or a precondensate thereof as a first shell forming material is allowed to exist in an oily liquid to be encapsuled, a second shell forming material having a group capable of reacting with the first shell forming material is dissolved in a polar solvent immiscible with aforesaid oily liquid, and the first shell forming material is polymerized with the second shell forming material at the interface between the oil droplets of aforesaid oily liquid and aforesaid polar solvent to form a shell, without using a polymer as a shell material for the microcapsules from the beginning.

(3) A method for polymerizing a monomer component in oil droplets (JP-B-36-9168) in which a compound having a double bond such as an acrylic compound, styrene or vinyl acetate is dissolved in oil droplets and a radical polymerization reaction is allowed to proceed in the presence of a peroxide compound as a catalyst to form an oil-insoluble polymer.

(4) Fusion dispersion cooling methods (British Patents 952,807 and 965,074) in which a stable material which is solid at room temperature, but is made liquid by heating, is used as a shell material for the microcapsules. Wax or thermoplastic resins are used.

(5) Spray drying methods (U.S. Pat. No. 3,111,407 and British Patent 930,422) which utilizes the principle of spray drying and in which an emulsion dispersion composed of solid particles or a liquid in a polymer solution is fed to a spray dryer, the emulsion is atomized in the form of fine particles from a atomizer and the material to be encapsulated is instantaneously surrounded by the polymer.

However, these methods have such problems in the production of the microcapsules that manufacturing processes are complicated and the size of the microcapsules can be hardly controlled. Further, there is a problem that the performance of the capsules is greatly affected by the solvents to be used as core materials. There is a possibility that the property of the diazonium salt is masked by coexisting solvents even when one tries to draw out the characteristics of the diazonium salt present in the capsules.

Accordingly, the present inventors have made studies to prepare the microcapsules, to find out a novel basic substance and to choose the type of supports. As a result, the present invention has been made.

SUMMARY OF THE INVENTION

A first object of the present invention is to provide a copying material which gives a high color density even by low-temperature development.

A second object of the present invention is to provide a copying material which has a good shelf life, that is, hardly causes the coloration (fogging) of its background during storage before copying and scarcely causes a lowering of color density.

A third object of the present invention is to provide a copying material which is excellent in the long-term preservability of the copied image (there is hardly caused a lowering of color density during storage in a light room or a dark room, and there is scarcely caused a rise in the coloration of the background).

A fourth object of the present invention is to provide a copying material excellent in water resistance, chemical resistance and wear resistance.

A fifth object of the present invention is to provide a copying material which allows its layer constitution to be simplified and can be easily produced.

A sixth object of the present invention is to provide a method for forming an image which is simple and which can be easily preserved, by combining a latent image forming exposure process with a heat development process by using the present copying material.

A seventh object of the present invention is to provide microcapsules containing a diazonium salt enclosed therein and substantially no solvent.

An eighth object of the present invention is to provide a stable process for producing microcapsules containing a diazonium salt enclosed therein and substantially no solvent.

The above-described objects of the present invention have been achieved by providing a heat-developable copying material comprising a support having provided thereon a light-sensitive layer comprising microcapsules containing a diazo compound and substantially no solvent, a coupling component and a basic substance.

DETAILED DESCRIPTION OF THE INVENTION

It is preferred that the microcapsules used in the present invention are those prepared in the following manner.

A diazonium salt, and the same or different kinds of compounds capable of reacting with each other to form a high-molecular weight material, are dissolved in a non-aqueous solvent having a boiling point of from 40° to 95° C. under atmospheric pressure. After the resulting solution is emulsified in a hydrophilic protective colloid solution, the temperature of the resulting system is elevated to allow the shell forming materials to migrate toward the surfaces of oil droplets and to allow a high molecular forming reaction by polyaddition and polycondensation to proceed on the surfaces of the oil droplets, thus forming the shells of the microcapsules. It is preferred that the above shell forming reaction is carried out by distilling the non-aqueous solvent while reducing pressure within the reaction vessel.

It is preferred that the non-aqueous solvent used in aforesaid manufacturing process of the microcapsule is at least one compound selected from the group consisting of halogenated hydrocarbons, fatty acid esters, ketones and ethers. It is preferred that the high-molecular weight material forming the shell of the microcapsule is at least one compound selected from polyurethanes and polyureas.

The non-aqueous solvent having a boiling point of not lower than 40° C., but not higher than 95° C. under atmospheric pressure, which can be used in the present invention, is used in an amount of preferably 5 to 100 parts by weight per 10 parts by weight of the diazonium salt solute.

Specific examples of the non-aqueous solvent which can be used in the present invention include, but are not limited to, (parenthesized figure represents boiling point °C. under atmospheric pressure) acetone (56), isoamyl methyl ether (91), isopropyl methyl ketone (94), methyl isobutyrate (92), ethyl isobutyl ether (79), ethyl isopropyl ether (54), ethyl propyl ether (64), t-amyl chloride (86), ethylene chloride (84), isobutyl chloride (69), butyl chloride (78), ethylidene chloride (57), propyl chloride (46), methylene chloride (42), ethyl formate (54), propyl formate (81), chloromethyl methyl ether (59), methyl chloroformate (71), ethyl acetate (77), methyl acetate (57), carbon tetrachloride (77), 1,1-dichloropropane (86), trichloroethylene (87), methyl propionate (80), propyl ether (91), methyl chloroform (74) and chloroform (61).

The microcapsule of the present invention is characterized in that the microcapsule contains substantially no non-aqueous solvent (the microcapsule is substantially free from non aqueous solvent). The present inventors have developed a method for determining the amount of the non-aqueous solvent contained in the microcapsule, and the present inventors thereby define the term "containing substantially no non-aqueous solvent" or "substantially free from non-aqueous solvent" as used herein.

The microcapsule of the present invention is seldom used in the form of a capsule solution alone. Generally, a coating solution comprising the capsule solution together with a coupling component and a basic substance is prepared, coated and dried to thereby allow them to be enclosed in a layer of the copying material. Accordingly, after the coating solution is applied for the layer, the amount of the non-aqueous solvent in the coated layer is no longer detectable, though several % of the non-aqueous solvent is contained in the capsule solution.

The method of determining the amount of the non-aqueous solvent contained in the microcapsule follows:

0.1 g of the microcapsule solution prepared according to the method of the present invention was weighed in a 20 cc volumetric flask. Methanol was added thereto to a volume of accurately 20 cc and the mixture was left to stand for 30 minutes. 2 cc of the resulting methanol solution was taken in a microsyringe and put into a gas chromatography mass spectrographic device ("M-80B", trade name, manufactured by Hitachi Ltd.). Column was TENAX® 3 mmϕ×1 m. The determination was made by using value of m/z peak according to the solvent to be measured (e.g., the peak of m/z=43 was used for determining ethyl acetate and the peak of m/z=84 was used for determining methylene chloride).

According to the above-described measuring method, the microcapsule solution of the present invention contained from 0.01 to 3.00% by weight of the non-aqueous solvent.

As the same kind or different kinds of compounds capable of reacting with each other to form a high-molecular weight material for the shell of the microcapsule of the present invention, polyurea and polyurethane forming compounds are preferred. Examples of the monomers which compose the high-molecular weight materials include aromatic or aliphatic isocyanate compounds, among which isocyanate compounds described below are preferred. The monomers are used in such an amount as to provide microcapsules having an average particle size (diameter) of from 0.3 to 12 μm and the shell thickness of from 0.01 to 0.3 μm.

Specific examples of the monomers which can be used in the present invention include, but are not limited to, the following compounds.

The aromatic isocyanate compounds which can be used in the present invention can be represented by the general formula (I).

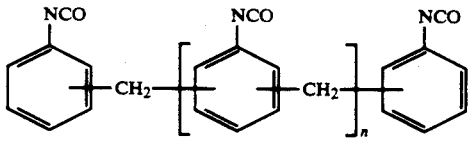

(I)

wherein n represents an integer of from 0 to 10.

These compounds (n=0, 1, 2, 3 . . . . . 10) may be used either alone or as a mixture of two or more of them.

Specific examples of the aliphatic polyhydric-isocyanates which can be used in the present invention include hexamethylene diisocyanate, propylene-1,2-diisocyanate, butylene-1,2-diisocyanate, ethylidene diisocyanate, cyclohexylene-1,4-diisocyanate, isophorone diisocyanate, an addition product of hexamethylene diisocyanate with trimethylolpropane, an addition product of hexamethylene diisocyanate with hexanetriol, biuret of hexamethylene diisocyanate, and an isocyanurate of hexamethylene diisocyanate.

A polymerization reaction may be carried out by allowing diamines and diols to coexist with the aforesaid diisocyanate for the purpose of modifying the physical properties of the shell of the microcapsule.

The diazo compound and the coupling component which are contained in the light-sensitive layer of the present invention, are brought into contact with each other by heating to thereby form a color. As the diazo compound there are used photo-decomposing compounds which are decomposed when exposed to light having a specific wavelength before the color forming reaction.

The photo-decomposing diazo compounds of the present invention are principally aromatic diazo compounds. Examples of the aromatic diazo compounds include those in the form of aromatic diazonium salts, diazo sulfonate compounds and diazoamino compounds. Generally, it is said that the photo-decomposing wavelengths of the diazo compounds are their maximum absorption wavelengths. It is known that the maximum absorption wavelengths of the diazo compounds vary from about 200 nm to about 700 nm according to the chemical structure thereof [see, Takahiko Tsunoda and Ao Yamaoka, "Photolysis and Chemical Structure of Photosensitive Diazonium Salt", *Bulletin of the Photographic Society of Japan*, No. 29 (4), pages 197 to 205 (1965)]. Namely, when the diazo compounds are used as the photo-decomposing compounds, they are decomposed by light having a specific wavelength according to the chemical structures thereof. When the chemical structures of the diazo compounds are changed, the hue of a dye after reaction can be changed, even when the diazo compounds are reacted with the same coupling component.

The diazo compounds are compounds represented by the general formula $ArN_2^{\oplus}X^{\ominus}$ (wherein Ar represents a substituted or unsubstituted aromatic ring, $N_2^{\oplus}$ represents a diazonium group, and $X^{\ominus}$ represents an acid anion).

In the present invention, multi-color heat-developable copying materials can be obtained by using the diazo compounds having different photo-decomposing wavelengths or different photo-decomposing rates.

Examples of the diazo compounds which can be used in the present invention include 4-diazo-1-dimethylaminobenzene, 4-diazo-2-butoxy-5-chloro-1-dimethylaminobenzene, 4-diazo-1-methylbenzylaminobenzene, 4-diazo-1-ethylhydroxyethylaminobenzene, 4-diazo-1-diethylamino-3-methoxybenzene, 4-diazo-1-morpholinobenzene, 4-diazo-1-morpholino-2,5-dibutoxybenzene, 4-diazo-1-toluylmercapto-2,5-diethoxybenzene, 4-diazo-1-piperazino-2-methoxy-5-chlorobenzene, 4-diazo-1-(N,N-dioctylaminocarbonyl)-benzene, 4-diazo-1-(4-tert-octylphenoxy)benzene, 4-diazo-1-(2-ethylhexanoylpiperidino)-2,5-dibutoxybenzene, 4-diazo-1-(2,5-di-tert-amylphenoxy-2-butanoylpiperidino)benzene, 4-diazo-1-(4-methoxy)phenylthio-2,5-diethoxybenzene, 4-diazo-1-(4-methoxy)benzamido-2,5-diethoxybenzene and 4-diazo-1-pyrrolidino-2-methoxybenzene.

Examples of acids capable of forming diazonium salts with aforesaid diazo compounds include $C_nF_{2n+1}COOH$ (wherein n is an integer of from 1 to 9), $C_mF_{2m+1}SO_3H$ (wherein m is an integer of from 1 to 9), tetrafluoroboric acid, tetraphenylboric acid, hexafluorophosphoric acid, aromatic carboxylic acids, aromatic sulfonic acids and metal halides (e.g., zinc chloride, cadmium chloride, tin chloride).

Examples of the hydrophilic protective colloid which can be used in the present invention include natural or synthetic hydrophilic high-molecular weight materials such as gelatin, gum arabic, casein, carboxymethyl cellulose, starch and polyvinyl alcohol.

Further, surfactants for emulsion may be used. Examples of the surfactants include anionic surfactants such as alkylbenzenesulfonates, alkylnaphthalenesulfonates, polyoxyethylene sulfate and Turkey red oil; and nonionic surfactants such as polyoxyethylene alkyl ethers and sorbitan fatty acids.

The coupling component of the present invention is coupled with the diazo compound in a basic atmosphere to form a dye. Examples of the coupling component include active methylene compounds having methylene group next to carbonyl group phenol derivatives and naphthol derivatives.

Specific examples of the coupling components include resorcin, phloroglucin, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanylnaphthalene, 2-hydroxy-3-naphthoic acid morpholinopropylamide, 2-hydroxy-3-naphthoic acid octylamide, 2-hydroxy-3-naphthoic acid anilide, benzoylacetanilide, 1-phenyl-3-methyl-5-pyrazolone, 1-(2,4,6-trichlorophenyl)-3-anilino-5-pyrazolone, 2-[3-α-(2,5-di-tert-amylphenoxy)butaneamidobenzamido]phenol, 2,4-bis(benzoylacetamino)toluene and 1,3-bis(pivaloylacetaminomethyl)benzene.

These coupling components may be used either alone or as a combination of two or more of them to obtain an image with any hue.

In order to obtain a substantially transparent light-sensitive layer in the present invention, the coupling component is dissolved in a organic solvent which is slightly soluble or insoluble in water, the solution is mixed with a water phase containing a surfactant and a water-soluble high-molecular weight material as protective colloid and the resulting mixture is used in the form of an emulsified dispersion.

If desired, low-boiling co solvents may be added to the organic solvents to obtain a transparent copying material in the present invention. The most preferred examples of the co-solvents include ethyl acetate, isopropyl acetate, butyl acetate and methylene chloride.

The organic solvent can be properly chosen from among high-boiling oils. Among them, preferred examples of the oils include compounds represented by the following general formulas [II] to [IV], triallylmethanes (e.g., tritoluylmethane, toluyldiphenylmethane), terphenyl compounds (e.g., terphenyl) and diphenyl ethers (e.g., diphenyl ether, propyldiphenyl ether) in addition to esters. Among them, the esters are preferred from the viewpoint of the stability of the emulsion.

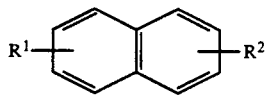

(II)

wherein $R^1$ and $R^2$, which may be the same or different, each represents at least one member selected from the group consisting of hydrogen and an alkyl group having from 1 to 18 carbon atoms.

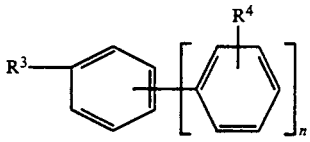

(III)

wherein $R^3$ and $R^4$, which may be the same or different, each represents at least one member selected from the group consisting of hydrogen and an alkyl group having from 1 to 12 carbon atoms, and n is an integer of 1 or 2.

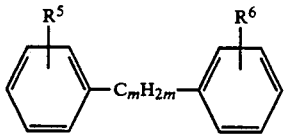

(IV)

wherein $R_5$ and $R_6$, which may be the same or different, each represents at least one member selected from the group consisting of hydrogen and an alkyl group having from 1 to 18 carbon atoms, and m is an integer of from 1 to 13.

Examples of the compounds represented by the general formula (II) include dimethylnaphthalene, diethylnaphthalene and diisopropylnaphthalene.

Examples of the compounds represented by the general formula (III) include dimethylbiphenyl, diethylbiphenyl, diisopropylbiphenyl and diisobutylbiphenyl.

Examples of the compounds represented by the general formula (IV) include 1 methyl-1-(2,4-dimethylphenyl)-1-phenylmethane, 1-ethyl-1-(2,4-dimethylphenyl)-1-phenylmethane and 1-propyl-1-(2,4-dimethylphenyl)-1-phenylmethane.

Examples of the esters include phosphoric acid esters (e.g., triphenyl phosphate, tricresyl phosphate, butyl phosphate, octyl phosphate, diphenyl cresyl phosphate), phthalic acid esters (e.g., dibutyl phthalate, 2-ethylhexyl phthalate, ethyl phthalate, octyl phthalate, butyl benzyl phthalate, dioctyl tetrahydrophthalate), benzoic acid esters (e.g., ethyl benzoate, propyl benzoate, butyl benzoate, isopentyl benzoate, benzyl benzoate), abietinic acid esters (e.g., ethyl abietate, benzyl abietate), dioctyl adipate, isodecyl succinate, dioctyl azelate, oxalic acid esters (e.g., dibutyl oxalate, dipentyl oxalate), diethyl malonate, maleic acid esters (e.g., dimethyl maleate, diethyl maleate, dibutyl maleate), tributyl citrate, sorbinic acid esters (e.g., methyl sorbate, ethyl sorbate, butyl sorbate), sebacinic acid esters (e.g., dibutyl sebacate, dioctyl sebacate), ethylene glycol esters (e.g., monoesters and diesters of formic acid, butyric acid, lauric acid, palmitic acid and stearic acid), triacetin, diethyl carbonate, diphenyl carbonate and boric acid esters (e.g., tributyl borate). These oils may be used alone or together with other oils.

The water-soluble high-molecular weight material as protective colloid to be incorporated in the water phase to be mixed with an oil phase containing these components, can be properly chosen from among known anionic high-molecular weight materials, nonionic high-molecular weight materials and amphoteric high-molecular weight materials. Among them, polyvinyl alcohol, gelatin and cellulose derivatives are preferred.

As the surfactant to be incorporated in the water phase, there are used materials properly chosen from among anionic surfactants and nonionic surfactants which cause neither precipitation nor agglomeration in co-reaction with aforesaid protective colloid. Preferred examples of the surfactants include sodium alkylbenzenesulfonates, sodium alkylsulfates, sodium dioctyl sulfosuccinate and polyalkylene glycols.

In order to obtain a transparent copying material, the emulsified dispersion of the present invention can be easily obtained by mixing the oil phase containing the above-described components with the water phase containing the protective colloid and the surfactant, and dispersing them in each other by conventional technique for fine particle emulsification such as high-speed stirring, ultrasonic dispersion, etc.

The oil droplet size (diameter) of the emulsified dispersion is preferably not larger than 7 μm, more preferably from 0.1 to 5 μm to obtain a transparent light-sensitive layer having a haze value of not higher than 40%.

The ratio of the oil phase to the water phase (weight of oil phase/weight of water phase) is in the range of preferably 0.02 to 0.6, more preferably 0.1 to 0.4. When the ratio is lower than 0.02, the amount of the water phase is too large, the dispersion is too dilute and sufficient color-forming property can not be obtained, while when the ratio is higher than 0.6, the viscosity of the dispersion is too high, the dispersion is not convenient to handle and lowering in the stability of the coating solution results.

It is preferred to add a basic substance of the present invention for the purpose of making the system basic during heat development to thereby accelerate the coupling reaction.

As the basic substance, there can be used substances which are slightly soluble or insoluble in water and substances which generate an alkali by heating.

Preferred examples of the basic substances include organic basic substances represented by the following general formulae [V] to [VIII].

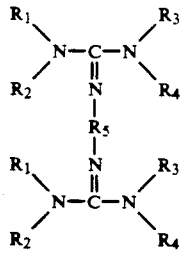

(V)

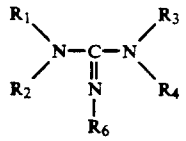

(VI)

wherein $R_1$, $R_2$, $R_3$, $R_4$ and $R_6$, which may be the same or different, each represents hydrogen, an alkyl group having not more than 18 carbon atoms, a cyclic alkyl group, an aryl group, an aralkyl group, an amino group, an alkylamino group, an acyl group, an acylamino group, a carbamoyl group or a residue of a heterocyclic ring (e.g., 2-pyridyl group or 2-imidazolyl group).

$R_5$ represents a lower alkylene group, phenylene, naphthylene or a group having the formula

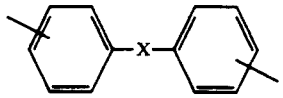

wherein X represents a lower alkylene, $SO_2$, $S_2$, S, O, NH or a single bond. The total carbon numbers of $R_5$ are preferably 1 to 18. The aryl groups in the formula may be optionally substituted with a lower alkyl group, an alkoxy group, a nitro group, an acyl group, an acylamino group, an amino group, an alkylamino group or a halogen atom (e.g., fluorine atom, chlorine atom or bromine atom). The total carbon numbers of the substituent for the aryl groups are preferably 1 to 8.

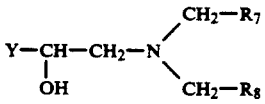

(VII)

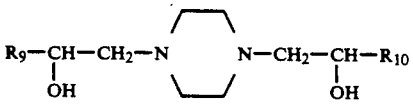

(VIII)

wherein Y represents a monovalent group such as a substituted or unsubstituted alkyl group, a substituted or unsubstituted aryl group, an amido group (e.g., an acetamide group or a benzamide group), an ester group (e.g., an ethoxycarbonyl group or an acetyloxy group), a ureido group (e.g., a phenylureido group), a sulfonyl group (e.g., a paratoluenesulfonyl group), an ether group (e.g., a methoxy group or a phenoxy group), a carbamoyl group (e.g., a phenylcarbamoyl group) or a thioether group (e.g., a phenylthio group). The total carbon numbers of Y are preferably 1 to 18. $R_7$ and $R_8$, which may be the same or different, each represents a substituted or unsubstituted alkyl group, a substituted or unsubstituted aryl group or a substituted or unsubstituted aralkyl group, or $R_7$ and $R_8$ may be combined together to form a ring which may optionally contain hetero atoms (e.g., a nitrogen atom, an oxygen atom or a sulfur atom). The total carbon numbers of $R_7$ or $R_8$ are preferably 1 to 18. $R_9$ and $R_{10}$, which may be the same or different, each represents an alkyl group, an aryl group, an aralkyl group, an alkoxy group, an aryloxy group, an alkylthio group or an arylthio group, each of which may have one or more substituent groups. Examples of substituent for Y, $R_7$, $R_8$, $R_9$ and $R_{10}$ include a halogen atom such as a chlorine atom, an amino group, an amide group, a carbonyloxy group, an oxycarbonyl group, an ureido group, a sulfonyl group, an ether group, a carbamoyl group, a thioether group, a carbonyl group, a hydroxy group and a carboxy group.

Specific examples of the organic basic substances represented by the general formulae (V) to (VIII), which can be used in the present invention include, but are not limited to, phenylguanidine, 1,3-diphenylguanidine, 1,3-di-o-tolylguanidine, 1,3-di-pmethoxyphenylguanidine, 1-dimethyl-3-phenylguanidine, 1-benzoyl-3-phenylguanidine, 1-benzyl-3-phenylguanidine, 1,2,3-triphenylguanidine, 1,1,3-triphenylguanidine, 1,2-dibenzoyl-3-phenylguanidine, 1,3-diphenyl-2-cyclohexylguanidine, o-tolylbiguanide, p-bis(1,3-diphenylguanidino)diphenyl, bis(phenylguanidino)ethane, bis(-triphenylguanidino)methane, 1,3-dicyclohexylguanidine, 1,2,3-tricyclohexylguanidine, N,N'-bis(3-phenoxy-2-hydroxypropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpiperazine, N-[3-(β-naphthoxy)-2-hydroxy]propylmorpholine, 1,4-bis[(3-morpholino-2-hydroxy)propyloxy]benzene, 1,3-bis[(3-morpholino-2-hydroxy)propyloxy]benzene and 1,4-bis{[3-(N-methylpiperazino)-2-hydroxy]propyloxy}benzene.

Of these, preferred organic basic substances are guanidine compounds such as 1,2,3-triphenylguanidine, 1,3-diphenyl-2-cyclohexylguanidine o-tolylbiguanide or 1,2,3-tricyclohexylguanidine and piperadine compounds, more preferred organic basic substances include guanidine compounds such as 1,2,3-triphenylguanidine or 1,2,3-tricyclohexylguanidine and piperadine compounds.

These organic basic substances may be used either alone or in a combination of two or more of them, or may be used together with other basic substances other than the organic basic substances represented by the formulae (V) to (VIII), in order to control heat developing temperature or hue of color formed, or to provide characteristics which are required for a stable production of copying materials. Examples of other basic substances include nitrogen-containing compounds such as inorganic and organic ammonium salts, organic amines, amides, urea and derivatives thereof, thiourea and derivatives thereof, thiazoles, pyrroles, pyrimidines, piperazines, guanidines, indoles, imidazoles, imidazolines, triazoles, morpholines, piperidines, amidines, pyridines and formamidines. These basic substances may be used either alone or in combination of two or more of them.

The diazo compound is coated in a coating weight of preferably 0.05 to 5.0 g/m$^2$ in the present invention. The coupling component is used in an amount of preferably 0.1 to 30 parts by weight per one part by weight of the diazo compound. The basic substance is used in an amount of preferably 0.1 to 30 parts by weight per one part by weight of the diazo compound.

It is preferable that the basic substance is used in the form of a dispersion prepared by dissolving aforesaid basic substance together with the coupling component in a slightly water-soluble or water-insoluble organic solvent and emulsifying them, when a transparent copying material is to be prepared.

In the present invention, one or more of the following color forming aid in addition to aforesaid basic substance can be added for the purpose of accelerating a color forming reaction. For example, phenol derivatives, naphthol derivatives, alkoxy-substituted benzenes, alkoxy-substituted naphthalenes, hydroxy compounds, amide compounds and sulfonamide compounds can be added to the light-sensitive layer so that heat development can be carried out quickly and completely with low energy. It is believed that these compounds cause the melting point of the coupling component or the basic substance to be lowered or they cause the heat permeability of the shell of the microcapsule to be improved and as a result, a high color density can be obtained.

The color forming aids of the present invention include heat-fusible materials. The heat-fusible materials are materials which are solid at room temperature, fuse by heating, have a melting point of 50° to 150° C. and dissolve the diazo compound, the coupling component or the basic substance. Examples of the heat-fusible materials include fatty acid amides, N-substituted fatty acid amides, ketone compounds, urea compounds and esters.

It is preferred that the coupling component, the basic substance and the color forming aid together with a water-soluble high-molecular weight material are dispersed in each other as solids in a sand mill, etc. Preferred examples of the water-soluble high-molecular weight materials are those which are used in the preparation of the microcapsule [see, JP-A-59-190886 (corresponding to U.S. Pat. No. 4,650,740-A) (the term "JP-A" as used herein means an "unexamined published Japanese patent application")]. The diazo compound, the coupling component, the basic substance and the color forming aid are fed to the mill in such a proportion that each amount is 5 to 40% by weight based on the amount of the water-soluble high-molecular weight material solution. It is preferred that the size of the dispersed grain is not larger than 10 μm.

Free radical generating agents (a compound capable of generating a free radical by the irradiation of light) used in photopolymerizable compositions can be added to the copying material of the present invention for the purpose of reducing the yellowing of background after copying. Examples of the free radical generating agents include aromatic ketones, quinones, benzoin, benzoin ethers, azo compounds, organic disulfides and acyl oxime esters. The free radical agents are used in an amount of preferably 0.01 to 5 parts by weight per one part by weight of the diazo compound.

Polymerizable compounds having an ethylenically unsaturated bond (hereinafter referred to as vinyl monomer) can be used for the purpose of reducing yellowing. The vinyl monomer is a compound having at least one ethylenically unsaturated bond (e.g., vinyl group, vinylidene group, etc.) in its chemical structure in the form of a monomer or a prepolymer. Examples of the vinyl monomer include unsaturated carboxylic acids and salts thereof, esters of unsaturated carboxylic acids with aliphatic polyhydric alcohols and amides of unsaturated carboxylic acids with aliphatic polyvalent-amine compounds. The vinyl monomer is used in an amount of 0.2 to 20 parts by weight per one part by weight of the diazo compound.

It is preferred that the free radical generating agent and the vinyl monomer together with the diazo compound are enclosed in the microcapsules.

In addition to the above-described materials, there can be added citric acid, tartaric acid, oxalic acid, boric acid, phosphoric acid, pyrophosphoric acid, etc. as acid stabilizers.

Coating can be conducted by using suitable binders to prepare the copying material of the present invention.

As the binder, there can be used various emulsions such as polyvinyl alcohol, methyl cellulose, carboxymethyl cellulose, hydroxypropyl cellulose, gum arabic, gelatin, polyvinyl pyrrolidone, casein, styrene butadiene latex, polyvinyl acetate, polyacrylic acid esters, ethylene-vinyl acetate copolymer, etc. The binder is used in an amount of 0.5 to 5 g/m$^2$ on a solid basis.

The copying material of the present invention is provided with a light-sensitive layer of 2.5 to 30 g/m$^2$ on a solid basis by preparing a coating solution containing the diazo compound contained in the a microcapsules, the coupling component, the basic substance and other additives, applying the coating solution on a support by a coating method such as bar coating, blade coating, air knife coating, gravure coating, roll coating, spray coating, dip coating or curtain coating, and then, drying it. In the copying material of the present invention, the microcapsules, the coupling component and the basic substance may be contained in the same layer. Alternatively, they are contained in separated layers to form a multi-layer structure. If desired, an intermediate layer is provided on a support and the light-sensitive layer may be coated on the intermediate layer as described, for example, in JP-A-61-54980.

As the support, there can be used any of paper supports which are conventionally used for pressure-sensitive paper, heat-sensitive paper and wet-process or dry-process diazo copying paper. In addition thereto, there can be used neutral paper having a pH of from 5 to 9 prepared by sizing a paper with a neutral sizing agent such as an alkyl ketene dimer etc. as described in Japanese Patent Application No. 55-14281; a paper satisfying the relationship between Stöckigt sizing degree and meter basis weight and having a Beck smoothness of not shorter than 90 seconds, described in JP-A-57-116687; paper having an optical surface roughness of 8μ or below and a thickness of from 30 to 150 μm described in JP-A-58-136492; paper having a density of not higher than 0.9 g/cm$^3$ and an optical contact percentage of not lower than 15% described in JP-A-58-69091; paper which prevents the coating solution from being soaked therein and prepared from beaten pulp which has a Canadian Standard Freeness (JIS P8121) of 400 cc or above described in JP-A-58-69097 (corresponding to U.S. Pat. No. 4,484,205-A); paper which improves a color density and resolving power and in which the glossy surface of base paper made by Yankee machine is a surface to be coated, described in JP-A-58-65695; and paper having improved coatability by subjecting base paper to corona discharge treatment, described in JP-A-59-35985.

Generally, paper supports as used for conventional diazo light-sensitive paper have been conventionally used as supports for heat developable copying materials. Namely, there are used papers having a paper surface having a pH of 3 to 4, obtained by adding alum as a fixing agent for rosin sizing agent to pulp (wood pulp of coniferous tree or broad-leaved tree) and making paper. However, the basic substance in the coated layer is gradually neutralized over a long period of time so that when the copying material having such paper support is stored over a long period of time before copying, color density formed is lowered. Therefore, it is preferred to use paper having a pH of from 5 to 9 as the support in the present invention. As pulp materials, wood pulp of needle leaf tree and broad-leaved tree can be used. For example, sulfite pulp, soda pulp, kraft pulp, semichemical pulp, chemigroundwood pulp and groundwood pulp can be used. Examples of sizing agents include neutral sizing agents such as petroleum resins, styrene resins, higher alcohols, alkenylsuccinic anhydrides and alkyl ketene dimers. Examples of fixing agents for sizing agents include polyamide, acrylamide and copolymers thereof and cationized starch. Further, melamine resin, urea resin, dialdehyde starch, oxidized starch, locust bean gum, carboxymethyl cellulose, polyacrylamide and copolymers thereof, sodium silicate, synthetic rubber latex and polyvinyl alcohol may be optionally used to strengthen the paper. Further, kaolin, calcium carbonate, talc, fine particles of urea-formalin copolymer and fine particles of polystyrene may be added as fillers for improving dimensional stability, printability and appearance.

Synthetic resin films used as the supports of the present invention, for example, transparent high-molecular weight material supports, can be properly chosen from among conventional materials which are not deformed by heating and have good dimensional stability. Examples of the films include polyester films such as polyethylene terephthalate film and polybutylene terephthalate film; cellulose derivative films such as cellulose triacetate film; and polyolefin films such as polystyrene film, polypropylene film and polyethylene film. These films may be used either alone or as a laminated film. The thickness of the support is 20 to 200 μm, preferably 50 to 180 μm.

In the copying material of the present invention, the image can be observed as a reflected image or a transmitted image from one side of the support by using the transparent support. Particularly, in the latter case, a white pigment may be added to the light-sensitive layer so that the back side of background does not become see-through.

The term "substantially transparent" as used herein means that haze (in % as measured by integrating sphere method HTR meter manufactured by Nippon Seimitsu Kogyo KK) is not higher than 40%, preferably not higher than 30%. The practical transparency of the copying material is greatly affected by light scattering due to fine unevenness on the surface of the copying material. Accordingly, when transparency inherent in the copying material, that is, transparency within the light-sensitive layer, is measured by haze meter, there is used a simple method that a transparent adhesive tape is stuck on the surface of the sensitive layer to compensate for scattering on the surface thereof and evaluation is made by measured values.

A protective layer may be provided on the light-sensitive layer to increase the mechanical strength of the surface of the copying material of the present invention. As a protective layer, aforesaid various binders may be used, and if necessary, pigments and waxes can be added. Among them, a protective layer composed of a silicon-modified polyvinyl alcohol and colloidal silica is pfererred for the purpose of the present invention.

Preferably, an image is formed on the copying material of the present invention in the following manner. In a first stage where exposure corresponding to the image of the original is conducted to form a latent image on the light-sensitive layer and area other than the image forming area is fixed by light irradiation, various fluorescent lamps, xenon lamp, mercury vapor lamp, etc. are used as the exposure light source. It is preferred that the emission spectrum thereof approximately accords with the absorption spectrum of the diazo compound used in the copying material, because the area other than the image forming area can be efficiently fixed by light. In a second stage, the whole surface of the light-sensitive layer is heated by a heating means such as thermal pen, thermal head, infrared rays, high frequency, heated block, heated roller, etc., to carry out development.

As described above, the copying material of the present invention has a good shelf life by using the microcapsules containing the diazo compound and substantially no solvent. Namely, the copying material of the present invention has a low density of coloration (fog) of the background during storage before copying and thus there is scarcely caused a lowering in color density formed by using the microcapsules containing the diazo compound and substantially free from the solvent.

Further, the copying material of the present invention is excellent in transparency and gives a high color density even by low-temperature heat development so that the copying material is suitable for use as a material for the second original drawing in the field of the copying of drawings. Particularly; the copying material of the present invention provides a high quality image by simple and easy maintenance method as compared with conventional wet-process and dry-process diazo type copying materials which are widely used.

The present invention is now illustrated in greater detail by reference to the following examples which, however, are not to be construed as limiting the present invention in any way. Unless otherwise specified, all parts, ratios and percentages are by weight.

EXAMPLE 1

3.45 parts of 1-morpholino-2,5-dibutoxybenzene-4-diazonium hexafluorophosphate and 18 parts of an adduct of xylylene diisocyanate and trimethylolpropane (3:1) were added to 10 parts of ethyl acetate. The mixture was heated to dissolve it. The resulting diazo compound solution was mixed with an aqueous solution of 5.2 parts of polyvinyl alcohol dissolved in 58 parts of water and emulsification dispersion was conducted at 20° C. to obtain an emulsion having an average particle diameter of 2.5 μm. 100 parts of water was added to the emulsion and the mixture was heated to 60° C. with stirring. After two hours, a capsule solution containing the diazo compound as a core material was obtained. During the reaction, the reaction vessel was kept under reduced pressure of from 100 to 130 mmHg by a water jet pump.

The amount of ethyl acetate in the capsule solution was measured by the aforesaid measuring method. There was obtained a value of 0.87%.

EXAMPLE 2

10 parts of 2-hydroxy-3-naphthoic acid anilide and 10 parts of triphenylguanidine were added to 200 parts of an aqueous solution of 5% by weight polyvinyl alcohol. The mixture was dispersed by means of a sand mill for about 24 hours to obtain a dispersion having an average particle diameter of 3 μm.

50 parts of the dispersion of the coupling component and triphenylguanidine and 10 parts of a dispersion of 40% calcium carbonate were added to 50 parts of the capsule solution of the diazo compound obtained in Example 1 to prepare a coating solution. Smooth wood free paper (75 g/m$^2$) was coated with aforesaid coating solution by using a coating bar in such an amount as to give a coating weight of 10 g/m$^2$ on a dry basis. The coated paper was dried at 50° C. for one minute to prepare a copying material.

0.05 m$^2$ of the copying material was immersed in 20 cc of methanol for one hour. The extract was measured by the aforesaid measuring method. The content of ethyl acetate was an amount which was not detectable.

EXAMPLE 3

Capsule Solution A was prepared in the same way as in Example 1.

25 parts of 1-(2,4,6-trichlorophenyl)-3-[3-{α-(2,5-di-tert-amylphenoxy)acetamido}benzamido]-2-pyrazoline-5-one and 50 parts of triphenylguanidine were dissolved in a solution previously prepared by mixing 100 parts of tricresyl phosphate with 200 parts of ethyl acetate. The resulting solution was mixed with 1,700 parts of a 4% by weight aqueous solution of polyvinyl alcohol and emulsification was conducted at 20° C. to prepare an emulsified dispersion having an average particle diameter of 3 μm.

50 parts of the above-prepared dispersion of the coupling component and triphenylguanidine and 10 parts of 40% by weight calcium carbonate dispersion were added to 50 parts of Capsule Solution A of the diazo compound to prepare a coating solution. A transparent polyethylene terephthalate film having a thickness of 75 μm was coated with aforesaid coating solution by using a coating bar in such an amount as to give a coating weight of 15 g/m$^2$ on a dry basis. The coated film was dried at 50° C. for one minute to prepare Copying Material B.

The above procedure of the preparation of Copying Material B was repeated except that a capsule solution prepared by the following method wa used in place of Capsule Solution A of Copying Material B. There was obtained Copying Material C.

Preparation of the Capsule Solution for Copying Material C 3.45 parts of 1-morpholino-2,5-dibutoxy-benzene-4-diazonium hexafluorophosphate and 18 parts of an adduct of xylylene diisocyanate and trimethylolpropane (3:1) were added to a mixed solvent of 6 parts of tricresyl phosphate and 5 parts of ethyl acetate. The mixture was heated to dissolve it. The resulting solution of the diazo compound was mixed with an aqueous solution of 5.2 parts of polyvinyl alcohol dissolved in 58 parts of water, and emulsification dispersion was conducted at 20° C. to obtain an emulsion having an average particle diameter of 2.5 μm. 100 parts of water was added to the emulsion. The mixture was heated to 60° C. with stirring. After two hours, a capsule solution containing the diazo compound as a core material was obtained.

The procedure of the preparation of Copying Material C was repeated except that a dispersion prepared by the following method was used in place of the dispersion of the above coupling component and triphenylguanidine. There was obtained Copying Material D.

Preparation of the Dispersion for Copying Material D 25 parts of 1-(2,4,6-trichlorophenyl)-3-[3 {α-(2,5-di-tert-amylphenoxy)acetamido}benzamido]-2pyrazoline-5-one and 50 parts of triphenylguanidine were added to 1700 parts of a 4% by weight aqueous solution of polyvinyl alcohol. The mixture was dispersed by means of a sand mill for about 24 hours to obtain the dispersion having an average particle diameter of 3 μm.

The haze transmittance of the copying materials was measured with the integrating sphere method HTR meter manufactured by Nippon Seimitsu Kogyo KK. The transparency of the copying materials was visually examined. The results are shown in Table 1.

TABLE 1

| Kind of Copying Material | Haze Transmittance (%) | Transparency |
|---|---|---|
| B | 10 | good |
| C | 35 | ordinary |
| D | 88 | bad |

The original for test (tracing paper uniformly painted black in a circle having a diameter of 3 cm with a 2B pencil) was placed on each of the copying materials B to D and exposure was conducted by using a fluorescent lamp. There was used a lamp whose emission spectrum had its maximum value at 420 nm. The material was heated for 3 seconds by using a heated block heated to 120° C. to form an image. Tests were conducted by using the heated blocks heated to 100° C. and 160° C.

Shelf life was tested in the following manner. After the copying materials were stored at 40° C. and 90% RH for 24 hours, exposure and development at 120° C. were carried out in the same way as described above. A shelf life test on storage at 60° C. and 30% RH for 24 hours was made. The density of each of the colored area and the background obtained by the test was measured with Macbeth densitometer.

The test results wherein the heating temperature is changed, are shown in Table 2 and the test results for shelf life test before copying are shown in Table 3.

Sample B has the highest image transmission density as shown in Table 2. This characteristics is also exhibited by Table 3 which shows forced deterioration test for the evaluation of the shelf life.

TABLE 2

| | Image Transmission Density | | | Background Transmission Density | | |
|---|---|---|---|---|---|---|
| Sample | 100° C. | 120° C. | 160° C. | 100° C. | 120° C. | 160° C. |
| B | 2.03 | 2.12 | 2.11 | 0.18 | 0.21 | 0.22 |
| C | 1.45 | 1.51 | 1.49 | 0.12 | 0.13 | 0.15 |
| D | 0.98 | 1.04 | 1.12 | 0.09 | 0.11 | 0.13 |

TABLE 3

| | Image Transmission Density | | | Background Transmission Density | | |
|---|---|---|---|---|---|---|
| Sample | Fresh | 40° C., 90% RH | 60° C., 30% RH | Fresh | 40° C., 90% RH | 60° C., 30% RH |
| B | 2.12 | 2.15 | 2.08 | 0.21 | 0.24 | 0.26 |
| C | 1.51 | 1.49 | 1.43 | 0.13 | 0.21 | 0.20 |
| D | 1.04 | 1.01 | 1.01 | 0.11 | 0.18 | 0.16 |

EXAMPLE 4

Preparation of Capsule Solution E of the Present Invention

The procedure of Example 1 was repeated except that stirring after adding water to the emulsion having an average particle diameter of 2.5 μm was carried out at 50° C. for 3 hours to obtain a capsule solution containing the diazo compound as a core material. During the reaction, the reaction vessel was kept under reduced pressure of 400 to 500 mmHg by means of a water jet pump. The amount of ethyl acetate in the capsule solution was measured by the aforesaid measuring method. There was obtained the value of 0.62%.

Preparation of Comparative Capsule Solution F 3.45 parts of 1-morpholino-2,5-dibutoxybenzene-4-diazonium hexafluorophosphate and 18 parts of an adduct of xylylene diisocyanate and trimethylolpropane (3:1) were added to a mixed solvent of 6 parts of tricresyl phosphate and 5 parts of ethyl acetate. The mixture was heated to dissolve it. The solution of the diazo compound was mixed with an aqueous solution of 5.2 parts of polyvinyl alcohol dissolved in 58 parts of water and emulsification dispersion was conducted at 20° C. to obtain an emulsion having an average particle diameter of 2.5 μm. 100 parts of water was added to the emulsion and the mixture was heated to 50° C. with stirring. After 3 hours, a capsule solution containing the diazo compound as a core material was obtained.

Preparation of Dispersion G of Coupler and Base According to the Present Invention 10 parts of 2-hydroxy-3-naphthoic acid anilide and 10 parts of 1,2,3-triphenylguanidine were added to 200 parts of an aqueous solution of 5% polyvinyl alcohol and the mixture was dispersed by means of a sand mill for about 24 hours to obtain Dispersion G having an average particle diameter of 3 μm.

Preparation of Dispersion H of Coupler and Basic Substance According to the Present Invention The procedure of the preparation of Dispersion G was repeated except that N,N'-bis(3-phenoxy-2-hydroxypropyl)piperazine was used in place of 1,2,3-triphenylguanidine.

Preparation of Comparative Dispersion I

The procedure of the preparation of Dispersion G was repeated except that stearylamine was used in place of triphenylguanidine.

Preparation of Copying Material J of the Present Invention 50 parts of Dispersion G and 10 parts of 40% calcium carbonate dispersion were added to 50 parts of the Capsule Solution E to prepare a coating solution. Smooth wood free paper (75 $gm^2$) was coated with the coating solution by means of a coating bar in such an amount as to give a coating weight of 10 $g/m^2$ on a dry basis. The coated paper was dried at 50° C. for one minute to prepare Copying Material J.

Preparation of Copying Material K of the Present Invention

The procedure of the preparation of Copying Material J was repeated except that Dispersion H was used to prepare Copying Material K.

Preparation of Comparative Copying Material L

The procedure of the preparation of Copying Material J was repeated except that Dispersion I was used to prepare Copying Material L.

Preparation of Comparative Copying Material M

The procedure of the preparation of Copying Material J was repeated except that Capsule Solution F was used to prepare Copying Material M.

Preparation of Comparative Copying Material N

The procedure of the preparation of Copying Material K was repeated except that Capsule Solution F was used to prepare Copying Material N.

Preparation of Comparative Copying Material O

The procedure of the preparation of Copying Material L was repeated except that Capsule Solution F was used to prepare Copying Material O.

The original for test (tracing paper painted uniformly black in a circle having a diameter of 3 cm with a 2B pencil) was placed on each of Copying Materials J to O, and exposure was conducted by using a fluorescent lamp. There was used a fluorescent lamp whose emission spectrum had its maximum value at 420 nm. The material was heated for 3 seconds by using a heated block heated to 120° C. to form an image. Tests were made by using heated blocks heated to 100° C. and 160° C.

Shelf life was tested in the following manner. After the copying materials were stored at 40° C. and 90% RH for 24 hours, exposure and development at 120° C. were conducted in a similar manner to that described above. Shelf life test on storage at 60° C. and 30% RH for 24 hours was made. The density of each of the colored area and the background of each sample was measured with Macbeth densitometer.

Test results wherein heating temperature is changed, are shown in Table 4. Test results for shelf life test before copying are shown in Table 5.

TABLE 4

| | Image Density | | | Background Density | | |
|---|---|---|---|---|---|---|
| Sample | 100° C. | 120° C. | 160° C. | 100° C. | 120° C. | 160° C. |
| J | 1.22 | 1.25 | 1.27 | 0.12 | 0.14 | 0.15 |
| K | 1.23 | 1.24 | 1.25 | 0.13 | 0.13 | 0.16 |
| L* | 0.78 | 0.96 | 1.23 | 0.25 | 0.28 | 0.29 |
| M* | 1.24 | 1.25 | 1.26 | 0.12 | 0.14 | 0.14 |
| N* | 1.23 | 1.24 | 1.24 | 0.13 | 0.14 | 0.15 |
| O* | 0.80 | 0.97 | 1.24 | 0.28 | 0.30 | 0.31 |

TABLE 5

| | Image Density | | | Background Density | | |
|---|---|---|---|---|---|---|
| Sample | Fresh | 40° C., 90% RH | 60° C., 30% RH | Fresh | 40° C., 90% RH | 60° C., 30% RH |
| J | 1.25 | 1.23 | 1.23 | 0.14 | 0.15 | 0.15 |
| K | 1.24 | 1.23 | 1.24 | 0.13 | 0.14 | 0.14 |
| L* | 0.96 | 0.92 | 0.90 | 0.28 | 0.36 | 0.41 |
| M* | 1.24 | 1.09 | 1.04 | 0.14 | 0.15 | 0.15 |
| N* | 1.22 | 1.04 | 1.01 | 0.14 | 0.14 | 0.15 |
| O* | 0.97 | 0.79 | 0.71 | 0.30 | 0.38 | 0.37 |

*Comparative Examples.

EXAMPLE 5

In this example, Capsule Solution E of example 4 was used as the Capsule Solution E of the present invention and Comparative Capsule Solution F of Example 4 was used as Comparative Capsule Solution F.

Preparation of Support P of the Present Invention

As the pulp of main component of the support, there was used the following mixture.

| | |
|---|---|
| Pulp of coniferous tree | 30% |
| Pulp of broad-leaved tree | 70% |

The above mixture was beaten to a CSF (Canadian Standard Freeness) of 310 ml by using a pulper, a refiner and Jordan engine, and used as a pulp. The resulting pulp was mixed with the following reagents.

| | |
|---|---|
| Pearl gum CS-25S (neutral sizing agent, manufactured by Seiko Kagaku KK) | 1.8% |
| Arafix 502 (fixing agent, manufactured by Arakawa Kagaku KK) | 0.4% |
| Melamine resin | 0.4% |
| Fine particle of urea-formalin resin | 2.0% |

(Each amount is based on the amount of the pulp.)

The resulting stock was fed to a Fourdrinier wire machine to make paper. As a surface sizing agent, the following solution was used.

| | |
|---|---|
| Polyvinyl alcohol | 0.6 parts by weight |
| Polyacrylamide-hydroxypropyl methacrylate copolymer | 0.8 parts by weight |
| Water | 98.6 parts by weight |

The above solution was coated in an amount of about 1.7 g/m$^2$ by a size press system to obtain Support P. The pH of the paper surface of Support P was 6.2, the base weight thereof was 50 g/m$^2$ and the thickness was 65 μm.

Preparation of Comparative Support Q

The pulp, the surface sizing agent and procedure were the same as those for Support P. The following reagents were added.

| | |
|---|---|
| Rosin sizing agent | 1.8% |
| Alum | 0.4% |
| Melamine resin | 0.4% |
| Fine particle of urea-formalin resin | 2.0% |

(Each amount being based on the amount of the pulp.)

The pH of the paper surface of Comparative Support Q was 3.6, the base weight was 50 g/m$^2$ and the thickness was 65 μm.

Preparation of Copying Material R of the Present Invention 10 parts of 2-hydroxy-3-naphthoic acid anilide and 10 parts of triphenylguanidine were added to 200 parts of an aqueous solution of 5% polyvinyl alcohol, and the mixture was dispersed by means of a sand mill for about 24 hours to obtain a dispersion having an average particle diameter of 3 μm. 50 parts of the dispersion and 10 parts of 40% calcium carbonate dispersion were added to 50 parts of the Capsule Solution E of the present invention to obtain a coating solution. Support P of the present invention was coated with the coating solution by means of a coating bar in such an amount as to give a coating weight of 10 g/m$^2$ on a dry basis. The coated support was dried at 50° C. for one minutes to prepare Copying Material R.

Preparation of Comparative Copying Material S

The procedure of the preparation of Copying Material R was repeated except that Capsule Solution F was used to prepare Copying Material S.

Preparation of Comparative Copying Material T

The procedure of the preparation of Copying Material R was repeated except that Support Q was used to prepare Copying Material T.

Preparation of Comparative Copying Material U

The procedure of the preparation of Copying Material S was repeated except that Support Q was used to prepare Copying Material U.

The original for test (tracing paper uniformly painted black in a circle having a diameter of 3 cm with 2B pencil) was placed on each of the copying materials R to U, and exposure was conducted by using a fluorescent lamp. There was used the lamp whose emission spectrum had its maximum value at 420 nm. The material was heated for 3 seconds by using a heated block heated to 120° C. to form an image.

Shelf life was tested in the following manner. After the copying materials were stored at 40° C. and 90% RH for 24 hours, exposure and development at 120° C. were conducted in a similar manner to that described above. A shelf life test on storage at 60° C. and 30% RH for 24 hours was made. The density of each of the colored area and the background of each sample was measured with Macbeth densitometer. The results are shown in Table 6.

TABLE 6

| Sample | Image Density | | | Background Density | | |
|---|---|---|---|---|---|---|
| | Fresh | 40° C., 90% RH | 60° C., 30% RH | Fresh | 40° C., 90% RH | 60° C., 30% RH |
| R | 1.28 | 1.25 | 1.26 | 0.12 | 0.13 | 0.13 |
| S* | 1.26 | 1.16 | 1.10 | 0.13 | 0.14 | 0.15 |
| T* | 1.25 | 1.12 | 1.08 | 0.13 | 0.15 | 0.15 |
| U* | 1.28 | 1.05 | 1.01 | 0.13 | 0.16 | 0.17 |

*Comparative Examples.

While the invention has been described in detail and with reference to specific embodiments thereof, it will be apparent to one skilled in the art that various changes and modifications can be made therein without departing from the spirit and scope thereof.

What is claimed is:

1. A heat-developable copying material comprising a support having thereon a heat-developable light-sensitive layer comprising (i) microcapsules containing a diazo compound and substantially no solvent, (ii) a coupling component, and (iii) a basic substance;

wherein said microcapsules are prepared by (a) dissolving a diazonium salt, and shell forming material of the same or different kinds of compounds capable of reacting with each other to form a high-molecular weight shell material, in a non-aqueous solvent having a boiling point of from 40° to 95° C. under atmospheric pressure, (b) emulsifying the resulting solution in a hydrophilic protective colloid solution to form oil droplets, and (c) elevating the temperature while reducing pressure to cause the shell forming material to migrate toward the surfaces of the oil droplets and to allow a high-molecular weight material forming reaction by a polyaddition reaction and polycondensation reaction to proceed, whereby shells for the microcapsules are formed to obtain the microcapsules containing substantially no solvent.

2. A heat-developable copying material as in claim 1, wherein said high-molecular weight material is formed of at least one member selected from the group consisting of polyureas and polyurethanes.

3. A heat-developable copying material as in claim 1, wherein said basic substance is at least one organic base compound selected from the group consisting of compounds represented by the following general formulas (V) to (VIII):

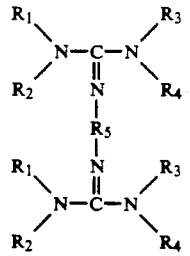

(V)

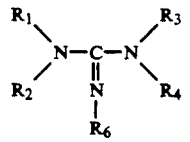

(VI)

wherein $R_1$, $R_2$, $R_3$, $R_4$ and $R_6$, which may be the same or different groups, each represents hydrogen, an alkyl group having not more than 18 carbon atoms, a cycloalkyl group, an aryl group, an aralkyl group, an amino group, an alkylamino group, an acyl group, an acylamino group, a carbamoyl group and a residue of a heterocyclic group; and $R_5$ is a lower alkylene group, phenylene group, naphthylene group or a group having the formula:

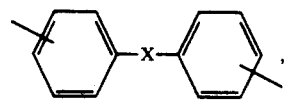

wherein X is a lower alkylene group, $SO_2$, $S_2$ S, O, NH or a single bond, and aryl groups in the formula may be optionally substituted with a lower alkyl group, an alkoxy group, nitro group, an acyl group, an acylamino group, an amino group, an alkylamino group or a halogen atom.

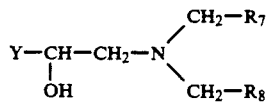

(VII)

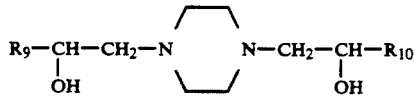

(VIII)

wherein Y represents a monovalent group, a substituted or unsubstituted alkyl group, an aryl group or a monovalent group having an amido group, an ester group, an ureido group, a sulfonyl group, an ether group, a carbamoyl group or a thioether group; $R_7$ and $R_8$, which may be the same or different groups, each represents a substituted or unsubstituted alkyl group, a substituted or unsubstituted aryl group or a substituted or unsubstituted aralkyl group, or $R_7$ and $R_8$ may be combined together to form a ring which may optionally contain heterocyclic atoms; and $R_9$ and $R_{10}$, which may be the same or different group, each represents an alkyl group, an aryl group, an aralkyl group, an alkoxy group, an aryloxy group, an alkylthio group or an arylthio group, each of which may have one or more substituent groups.

4. A heat-developable copying material as in claim 1, wherein said support is a paper support having a surface pH of from 5 to 9.

5. A heat-developable copying material as in claim 1, wherein said support is a transparent support.

6. A method for forming an image comprising carrying out a first light irradiation stage wherein the copying material as in claim 1 is subjected to an image-wise exposure operation corresponding to an image on an original to form a latent image on the light-sensitive layer and to fix area other than the image forming area by the light irradiation; and then a second stage wherein the whole surface of the light-developable layer of the copying material is heated by a heating means to carry out development.

7. A heat-developable copying material as in claim 1, wherein said coupler component and said basic substance are outside said microcapsules.

8. A heat-developable copying material as in claim 1, wherein the diazo compound is selected from the group consisting of compounds represented by the following formula:

$$ArN_2^{\oplus}X^{\ominus} \quad (I)$$

wherein Ar represents a substituted or unsubstituted aromatic ring, $N_2^{\oplus}$ represents a diazonium group, and $X^{\ominus}$ represents an acid anion.

9. A heat-developable copying material as in claim 5, wherein the coupling component is dissolved in a slightly water-soluble or a water-insoluble organic solvent to allow it to exist as oil droplets prior to coating to provide a substantially transparent light-sensitive layer.

10. A heat-developable copying material as in claim 1, wherein the coating weight of the diazo compound is 0.05 to 50 $g/m^2$, a coupling component is present in an amount of 0.1 to 30 parts by weight per 1 part by weight of the diazo compound and the basic substance is present in an amount of 0.1 to 30 parts by weight per 1 part by weight of the diazo compound.

11. A heat-developable copying material as in claim 1, wherein the basic substance and the coupling component are coated in the form of a dispersion prepared by dissolving them in a slightly water-soluble or water-insoluble organic solvent and emulsifying them, to provide a transparent copying material.

12. A heat-developable copying material as in claim 5, wherein said transparent support is formed of a synthetic resin film.

13. A heat-developable copying material as in claim 11, wherein said slightly water-soluble or water-insoluble organic solvent is an ester compound.

* * * * *